US012116646B2

(12) United States Patent
Sakakibara et al.

(10) Patent No.: US 12,116,646 B2
(45) Date of Patent: Oct. 15, 2024

(54) HOT-ROLLED STEEL SHEET

(71) Applicant: NIPPON STEEL CORPORATION, Tokyo (JP)

(72) Inventors: Mutsumi Sakakibara, Tokyo (JP); Hiroshi Shuto, Tokyo (JP); Kazumasa Tsutsui, Tokyo (JP); Koutarou Hayashi, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 115 days.

(21) Appl. No.: 17/907,883

(22) PCT Filed: Mar. 8, 2021

(86) PCT No.: PCT/JP2021/008987
§ 371 (c)(1),
(2) Date: Aug. 29, 2022

(87) PCT Pub. No.: WO2021/182395
PCT Pub. Date: Sep. 16, 2021

(65) Prior Publication Data

US 2023/0133134 A1 May 4, 2023

(30) Foreign Application Priority Data

Mar. 11, 2020 (JP) ..... 2020-041524

(51) Int. Cl.

| | |
|---|---|
| ***C21D 9/46*** | (2006.01) |
| ***C21D 8/02*** | (2006.01) |
| ***C22C 38/00*** | (2006.01) |
| ***C22C 38/02*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |
| ***C22C 38/58*** | (2006.01) |

(52) U.S. Cl.
CPC ..... *C21D 8/0226* (2013.01); *C21D 9/46* (2013.01); *C22C 38/001* (2013.01); *C22C 38/002* (2013.01); *C22C 38/005* (2013.01); *C22C 38/008* (2013.01); *C22C 38/02* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C22C 38/58* (2013.01); *C21D 2211/001* (2013.01); *C21D 2211/005* (2013.01)

(58) Field of Classification Search
CPC ..... C21D 9/46
See application file for complete search history.

(56) References Cited

U.S. PATENT DOCUMENTS

| | | | | |
|---|---|---|---|---|
| 6,544,354 | B1 | 4/2003 | Kawano et al. | |
| 2014/0000769 | A1 | 1/2014 | Takahashi et al. | |
| 2014/0227556 | A1 | 8/2014 | Sato et al. | |
| 2014/0234659 | A1 | 8/2014 | Kawata et al. | |
| 2016/0017465 | A1* | 1/2016 | Toda | C22C 38/22 420/83 |
| 2017/0044638 | A1 | 2/2017 | Yokoi et al. | |
| 2021/0095356 | A1 | 4/2021 | Yokoyama et al. | |
| 2022/0119902 | A1* | 4/2022 | Shuto | C22C 38/50 |
| 2023/0133134 | A1 | 5/2023 | Sakakibara et al. | |

FOREIGN PATENT DOCUMENTS

| | | | | |
|---|---|---|---|---|
| EP | 0 952 235 | A1 | 10/1999 | |
| JP | 10-168544 | A | 6/1998 | |
| JP | 11-61326 | A | 3/1999 | |
| JP | 2001-32041 | A | 2/2001 | |
| JP | 2005-179703 | A | 7/2005 | |
| JP | 2005-298924 | A | 10/2005 | |
| JP | 2007-70660 | A | 3/2007 | |
| JP | 4109619 | B2 | 7/2008 | |
| JP | 2010-275627 | A | 12/2010 | |
| JP | 5655712 | B2 | 1/2015 | |
| JP | 2015-151600 | A | 8/2015 | |
| JP | 2017-145469 | A | 8/2017 | |
| JP | 6241273 | B2 | 12/2017 | |
| JP | 6414371 | B1 | 10/2018 | |
| WO | WO 2012/128228 | A1 | 9/2012 | |
| WO | WO 2013/047760 | A1 | 4/2013 | |
| WO | WO-2014171427 | A1 * | 10/2014 | C21D 8/0263 |
| WO | WO 2015/118864 | A1 | 8/2015 | |
| WO | WO 2015/162932 | A1 | 10/2015 | |

OTHER PUBLICATIONS

U.S. Office Action for U.S. Appl. No. 17/422,406, dated Feb. 20, 2024.

* cited by examiner

*Primary Examiner* — Jophy S. Koshy
(74) *Attorney, Agent, or Firm* — Birch, Stewart, Kolasch & Birch, LLP

(57) ABSTRACT

This hot-rolled steel sheet has a predetermined chemical composition, in a microstructure, by area %, ferrite is less than 15.0%, residual austenite is less than 3.0%, $L_{52}/L_7$, which is a ratio of a length $L_{52}$ of a grain boundary having a crystal orientation difference of 52° to a length $L_7$ of a grain boundary having a crystal orientation difference of 7° about a <110> direction is 0.10 to 0.18, a standard deviation of a Mn concentration is 0.60 mass % or less, and a tensile strength is 980 MPa or more.

4 Claims, 1 Drawing Sheet

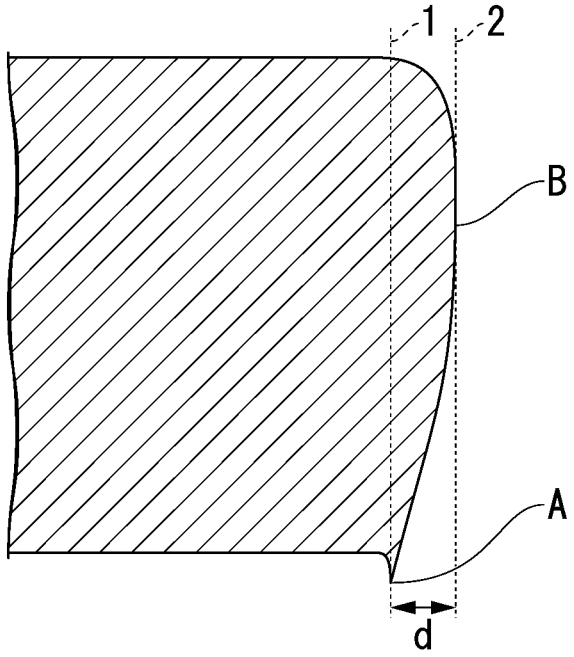
1
2
B
A
d

HOT-ROLLED STEEL SHEET

TECHNICAL FIELD OF THE INVENTION

The present invention relates to a hot-rolled steel sheet. Specifically, the present invention relates to a hot-rolled steel sheet that is formed into various shapes by press working or the like to be used, and particularly relates to a hot-rolled steel sheet that has high strength and has excellent ductility and shearing workability.

Priority is claimed on Japanese Patent Application No. 2020-041524, filed on Mar. 11, 2020, the content of which is incorporated herein by reference.

RELATED ART

In recent years, from the viewpoint of protecting the global environment, efforts have been made to reduce an amount of carbon dioxide gas emitted in many fields. Vehicle manufacturers are also actively developing techniques for reducing a weight of vehicle bodies for the purpose of reducing fuel consumption. However, it is not easy to reduce the weight of vehicle bodies since the emphasis is placed on improvement in collision resistance to secure the safety of the occupants.

In order to achieve both vehicle body weight reduction and collision resistance, an investigation has been conducted to make a member thin by using a high strength steel sheet. Therefore, a steel sheet having both high strength and excellent formability is strongly desired. Several techniques have been proposed from the related art to meet these demands.

Since there are various working forms for vehicle members, the formability required for a steel sheet differs depending on members to which they are applied, but among these, ductility is placed as important indices for formability.

In addition, vehicle members are formed by press forming, and the press-formed blank sheet is often manufactured by highly productive shearing working.

For example, Patent Document 1 discloses a high strength steel sheet for a vehicle having excellent collision resistant safety and formability, in which residual austenite having an average crystal grain size of 5 μm or less is dispersed in ferrite having an average crystal grain size of 10 μm or less. In the steel sheet containing residual austenite in the microstructure, while the austenite is transformed into martensite during working and large elongation is exhibited due to transformation-induced plasticity, the formation of full hard martensite impairs hole expansibility. Patent Document 1 discloses that not only ductility but also hole expansibility are improved by refining the ferrite and the residual austenite.

Patent Document 2 discloses a high strength steel sheet having excellent elongation and stretch flangeability and having a tensile strength of 980 MPa or more, in which a second phase consisting of residual austenite and/or martensite is finely dispersed in crystal grains.

Regarding a technique for improving shearing workability, for example, Patent Document 3 discloses a technique for controlling burr height after punching by controlling a ratio $d_s/d_b$ of the ferrite grain size $d_s$ of the surface layer to the ferrite crystal grain $d_b$ of an inside to 0.95 or less.

Patent Document 4 discloses a technique for improving separations or burrs on an end surface of a sheet by reducing a P content.

PRIOR ART DOCUMENT

Patent Document

[Patent Document 1] Japanese Unexamined Patent Application, First Publication No. H11-61326

[Patent Document 2] Japanese Unexamined Patent Application, First Publication No. 2005-179703

[Patent Document 3] Japanese Unexamined Patent Application, First Publication No. H10-168544

[Patent Document 4] Japanese Unexamined Patent Application, First Publication No. 2005-298924

DISCLOSURE OF THE INVENTION

Problems to be Solved by the Invention

The techniques disclosed in Patent Documents 1 to 4 are all techniques for improving either ductility or an end surface property after shearing working. However, Patent Documents 1 to 3 do not refer to a technique for achieving both of the properties. Patent Document 4 refers to achievement of both shearing workability and press formability. However, since the strength of a steel sheet disclosed in Patent Document 4 is less than 850 MPa, it may be difficult to apply the steel sheet to a member having a high strength of 980 MPa or more.

In addition, particularly for a steel sheet having a high strength of 980 MPa or more, the load required for a post-treatment such as coining after shearing working is large, and thus it is desired to control a height difference of an end surface after shearing working with particularly high accuracy. When not only a shape of the end surface after shearing working but also the damage of the end surface after shearing working vary, a deterioration of formability may be caused due to a concentration of stress in a significantly damaged site.

The present invention has been made in view of the above problems of the related art, and an object of the present invention is to provide a hot-rolled steel sheet having high strength and excellent ductility and shearing workability. More preferably, an object of the present invention is to provide a hot-rolled steel sheet having the above various properties and, furthermore, excellent workability of an end surface after shearing working.

Means for Solving the Problem

In view of the above problems, the present inventors have conducted intensive studies on a chemical composition of a hot-rolled steel sheet and a relationship between a microstructure and mechanical properties. As a result, the following findings (a) to (i) were obtained, and the present invention was completed.

In addition, the expression of having excellent shearing workability indicates that a height difference of an end surface after shearing working is small. In addition, the expression of having excellent strength or having high strength indicates that a tensile strength is 980 MPa or more. Furthermore, the expression of having excellent workability of the end surface after shearing working indicates that a variation in hardness of the end surface after shearing working in a sheet thickness direction is small.

(a) In order to obtain an excellent tensile (maximum) strength, a primary phase structure of a microstructure is preferably full hard. That is, it is preferable that a soft microstructural fraction of ferrite or the like is as small as possible.

(b) However, excellent shearing workability cannot be secured only by forming a microstructure mainly containing a full hard structure.

(c) In order to provide the high-strength hot-rolled steel sheet with the workability of the end surface after shearing working as well, it is effective to make the structure contained in the steel sheet uniform.

(d) In order to make the structure full hard and uniform, it is effective to set the cooling rate such that the precipitation of a soft structure such as ferrite can be suppressed during cooling after finish rolling.

(e) A full hard structure is generally formed in a phase transformation at 600° C. or lower, but in this temperature range, a large number of a grain boundary having a crystal orientation difference of 52° and a grain boundary having a crystal orientation difference of 7° about a <110> direction are formed.

(f) When forming the grain boundary having a crystal orientation difference of 7° about the <110> direction, dislocations are less likely to accumulate in a full hard phase. Therefore, in a microstructure in which such a grain boundary is uniformly dispersed at a high density (that is, a total length of the grain boundary having a crystal orientation difference of 7° about the <110> direction is large), introduction of dislocations into the microstructure by shearing working is easy, and distortion of a material during shearing working is promoted. As a result, the height difference of the end surface after shearing working is suppressed.

(g) In order to uniformly disperse the grain boundary having a crystal orientation difference of 7° about the <110> direction, a standard deviation of a Mn concentration needs to be set to a certain value or less. In order to set the standard deviation of the Mn concentration to equal to or less than a certain value, it is effective to hold a slab in a temperature range of 700° C. to 850° C. for 900 seconds or longer at the time of heating the slab, retain the slab in a temperature range of 1100° C. or higher for 6000 seconds or longer, and perform hot rolling so that a sheet thickness is reduced by a total of 90% or more in a temperature range of 850° C. to 1100° C.

(h) In order to increase a length $L_7$ of the grain boundary having a crystal orientation difference of 7° about the <110> direction and decrease a length $L_{52}$ of the grain boundary having a crystal orientation difference of 52° about the <110> direction, it is effective to set a coiling temperature to a predetermined temperature or higher.

(i) In order to suppress a variation in the hardness of the end surface in the sheet thickness direction after shearing working, it is effective to suppress the formation of residual austenite and to suppress the standard deviation of Vickers hardness. In addition, in order to suppress the standard deviation of Vickers hardness, it is effective to reduce an amount of ferrite and to control an average cooling rate in a predetermined temperature range after coiling.

The gist of the present invention made based on the above findings is as follows.

(1) A hot-rolled steel sheet according to an aspect of the present invention includes, as a chemical composition, by mass %:

C: 0.100% to 0.250%,
Si: 0.05% to 2.00%,
Mn: 1.00% to 4.00%,
sol. Al: 0.001% to 2.000%,
P: 0.100% or less,
S: 0.0300% or less,
N: 0.1000% or less,
O: 0.0100% or less,
Ti: 0% to 0.300%,
Nb: 0% to 0.100%,
V: 0% to 0.500%,
Cu: 0% to 2.00%,
Cr: 0% to 2.00%,
Mo: 0% to 1.00%,
Ni: 0% to 2.00%,
B: 0% to 0.0100%,
Ca: 0% to 0.0200%,
Mg: 0% to 0.0200%,
REM: 0% to 0.1000%,
Bi: 0% to 0.020%,
one or two or more of Zr, Co, Zn, and W: 0% to 1.00% in total,
Sn: 0% to 0.050%, and
a remainder comprising Fe and impurities,
in which, in a microstructure,
by area %, ferrite is less than 15.0%, residual austenite is less than 3.0%,
$L_{52}/L_7$, which is a ratio of a length $L_{52}$ of a grain boundary having a crystal orientation difference of 52° to a length $L_7$ of a grain boundary having a crystal orientation difference of 7° about a <110> direction is 0.10 to 0.18,
a standard deviation of a Mn concentration is 0.60 mass % or less, and
a tensile strength is 980 MPa or more.

(2) The hot-rolled steel sheet according to (1), in which, in the microstructure,
by the area %, the ferrite may be 10.0% or less, and
a standard deviation of Vickers hardness may be 20 HV0.01 or less.

(3) The hot-rolled steel sheet according to (1) or (2) may further include, as the chemical composition, by mass %, one or two or more selected from a group consisting of Ti: 0.005% to 0.300%,
Nb: 0.005% to 0.100%,
V: 0.005% to 0.500%,
Cu: 0.01% to 2.00%,
Cr: 0.01% to 2.00%,
Mo: 0.01% to 1.00%,
Ni: 0.02% to 2.00%,
B: 0.0001% to 0.0100%,
Ca: 0.0005% to 0.0200%,
Mg: 0.0005% to 0.0200%,
REM: 0.0005% to 0.1000%, and
Bi: 0.0005% to 0.020%.

Effects of the Invention

According to the above aspect according to the present invention, it is possible to obtain a hot-rolled steel sheet having excellent strength, ductility, and shearing workability. In addition, according to the preferable aspect according to the present invention, it is possible to obtain a hot-rolled steel sheet having the above various properties and, furthermore, excellent workability of an end surface after shearing working. The hot-rolled steel sheet according to the above aspect of the present invention is suitable as an industrial material used for vehicle members, mechanical structural members, and building members.

BRIEF DESCRIPTION OF THE DRAWING

FIG. 1 is a view for describing a method for measuring a height difference of an end surface after shearing working.

EMBODIMENTS OF THE INVENTION

The chemical composition and microstructure of a hot-rolled steel sheet according to the present embodiment (hereinafter, sometimes simply referred to as the steel sheet) will be more specifically described below. However, the present invention is not limited only to a configuration disclosed in the present embodiment, and various modifications can be made without departing from the scope of the gist of the present invention.

The numerical limit range described below with "to" in between includes the lower limit and the upper limit. Regarding the numerical value indicated by "less than" or "more than", the value does not fall within the numerical range. In the following description, % regarding the chemical composition of the steel sheet is mass % unless particularly otherwise specified.

1. Chemical Composition

The hot-rolled steel sheet according to the present embodiment includes, by mass %, C: 0.100% to 0.250%, Si: 0.05% to 2.00%, Mn: 1.00% to 4.00%, sol. Al: 0.001% to 2.000%, P: 0.100% or less, S: 0.0300% or less, N: 0.1000% or less, O: 0.0100% or less, and a remainder comprising Fe and impurities. Each element will be described in detail below.

(1-1) C: 0.100% to 0.250%

C increases a fraction of a hard phase. When the C content is less than 0.100%, it is difficult to obtain a desired strength. Therefore, the C content is set to 0.100% or more. The C content is preferably 0.120% or more and more preferably 0.150% or more. On the other hand, when the C content is more than 0.250%, since the transformation rate becomes slow, the formation of MA is easy, it becomes difficult to obtain a structure having a uniform strength, and the height difference of the end surface after shearing working becomes large. Therefore, the C content is set to 0.250% or less. The C content is preferably 0.220% or less.

(1-2) Si: 0.05% to 2.00%

Si has an action of delaying the precipitation of cementite. This action makes it possible to maintain a large amount of solid solution C in the hard phase and prevent the coarsening of cementite and consequently makes it possible to increase the strength of the steel sheet. In addition, Si itself has an effect on an increase in the strength of the steel sheet by solid solution strengthening. In addition, Si has an action of making steel sound by deoxidation (suppressing the occurrence of a defect such as a blowhole in steel). When the Si content is less than 0.05%, an effect by the action cannot be obtained. Therefore, the Si content is set to 0.05% or more. The Si content is preferably 0.50% or more or 0.80% or more. However, when the Si content is more than 2.00%, the precipitation of cementite is significantly delayed, and an area fraction of residual austenite increases to become 3.0% or more, which is not preferable. In addition, when the Si content is more than 2.00%, the surface properties, chemical convertibility, ductility and weldability of the steel sheet significantly deteriorate, and the $A_3$ transformation point significantly increases. Therefore, it may become difficult to perform hot rolling in a stable manner. Therefore, the Si content is set to 2.00% or less. The Si content is preferably 1.70% or less or 1.50% or less.

(1-3) Mn: 1.00% to 4.00%

Mn has an action of suppressing ferritic transformation to increase the strength of the steel sheet. When the Mn content is less than 1.00%, a tensile strength of 980 MPa or more cannot be obtained. Therefore, the Mn content is set to 1.00% or more. The Mn content is preferably 1.50% or more and more preferably 1.80% or more. On the other hand, when the Mn content is more than 4.00%, an angle difference of crystal grains in the hard phase becomes non-uniform due to the segregation of Mn, and the height difference of the end surface after shearing working becomes large. Therefore, the Mn content is set to 4.00% or less. The Mn content is preferably 3.70% or less or 3.50% or less.

(1-4) sol. Al: 0.001% to 2.000%

Similar to Si, Al has an action of delaying the precipitation of cementite. This action makes it possible to maintain a large amount of solid solution C in the hard phase and prevent the coarsening of cementite and consequently makes it possible to increase the strength of the steel sheet. In addition, Al has an action of deoxidizing steel to make the steel sheet sound. When the sol. Al content is less than 0.001%, an effect by the action cannot be obtained. Therefore, the sol. Al content is set to 0.001% or more. The sol. Al content is preferably 0.010% or more. On the other hand, when the sol. Al content is more than 2.000%, the precipitation of cementite is significantly delayed, and the area fraction of residual austenite increases to become 3.0% or more, which is not preferable economically. Therefore, the sol. Al content is set to 2.000% or less. The sol. Al content is preferably 1.500% or less or 1.300% or less.

The sol. Al in the present embodiment means acid-soluble Al and refers to solid solution Al present in steel in a solid solution state.

(1-5) P: 0.100% or Less

P is an element that is generally contained as an impurity and is also an element having an action of increasing the strength by solid solution strengthening. Therefore, P may be positively contained, but P is also an element that is easily segregated. When the P content exceeds 0.100%, the deterioration of ductility becomes significant due to boundary segregation. Therefore, the P content is set to 0.100% or less. The P content is preferably 0.030% or less. The lower limit of the P content does not need to be particularly specified, but is preferably set to 0.001% or more from the viewpoint of the refining cost.

(1-6) S: 0.0300% or Less

S is an element that is contained as an impurity and forms sulfide-based inclusions in steel to degrade the ductility of the hot-rolled steel sheet. When the S content exceeds 0.0300%, the ductility of the steel sheet significantly deteriorates. Therefore, the S content is set to 0.0300% or less. The S content is preferably 0.0050% or less. The lower limit of the S content does not need to be particularly specified, but is preferably set to 0.0001% or more from the viewpoint of the refining cost.

(1-7) N: 0.1000% or Less

N is an element that is contained in steel as an impurity and has an action of degrading the ductility of the steel sheet. When the N content is more than 0.1000%, the ductility of the steel sheet significantly deteriorates. Therefore, the N content is set to 0.1000% or less. The N content is preferably 0.0800% or less and more preferably 0.0700% or less. Although the lower limit of the N content does not need to be particularly specified, as will be described later, in a case where one or two or more of Ti, Nb, and V are contained to refine the microstructure, the N content is preferably set to 0.0010% or more and more preferably set to 0.0020% or more to promote the precipitation of carbonitrides.

(1-8) O: 0.0100% or Less

When a large amount of O is contained in steel, O forms a coarse oxide that becomes the origin of fracture and causes brittle fracture and hydrogen-induced cracks. Therefore, the O content is set to 0.0100% or less. The O content is preferably 0.0080% or less or 0.0050% or less. The O content may be set to 0.0005% or more or 0.0010% or more to disperse a large number of fine oxides when molten steel is deoxidized.

The remainder of the chemical composition of the hot-rolled steel sheet according to the present embodiment comprises Fe and impurities. In the present embodiment, the impurities mean a substance that is incorporated from ore as a raw material, a scrap, manufacturing environment, or the like or a substance that is intentionally added and a substance that is allowed to an extent that the hot-rolled steel sheet according to the present embodiment is not adversely affected.

In addition to the above elements, the hot-rolled steel sheet according to the present embodiment may contain Ti, Nb, V, Cu, Cr, Mo, Ni, B, Ca, Mg, REM, Bi, Zr, Co, Zn, W, and Sn as optional elements. In a case where the above optional elements are not contained, the lower limit of the content thereof is 0%. Hereinafter, the above optional elements will be described in detail.

(1-9) Ti: 0.005% to 0.300%, Nb: 0.005% to 0.100%, and V: 0.005% to 0.500%

Since all of Ti, Nb, and V are precipitated as a carbide or a nitride in steel and have an action of refining the microstructure by a pinning effect, one or two or more of these elements may be contained. In order to more reliably obtain the effect by the action, it is preferable that the Ti content is set to 0.005% or more, the Nb content is set to 0.005% or more, or the V content is set to 0.005% or more. However, even when these elements are excessively contained, the effect by the action is saturated, which is not economically preferable. Therefore, the Ti content is set to 0.300% or less, the Nb content is set to 0.100% or less, and the V content is set to 0.500% or less.

(1-10) Cu: 0.01% to 2.00%, Cr: 0.01% to 2.00%, Mo: 0.01% to 1.00%, Ni: 0.02% to 2.00%, and B: 0.0001% to 0.0100%

All of Cu, Cr, Mo, Ni, and B have an action of enhancing the hardenability of the steel sheet. In addition, Cr and Ni have an action of stabilizing residual austenite, and Cu and Mo have an action of precipitating a carbide in steel to increase the strength. Furthermore, in a case where Cu is contained, Ni has an action of effectively suppressing the grain boundary cracking of a slab caused by Cu. Therefore, one or two or more of these elements may be contained.

Cu has an action of enhancing the hardenability of the steel sheet and an action of being precipitated as a carbide in steel at a low temperature to increase the strength of the steel sheet. In order to more reliably obtain the effect by the action, the Cu content is preferably set to 0.01% or more and more preferably set to 0.05% or more. However, when the Cu content is more than 2.00%, grain boundary cracking may occur in the slab in some cases. Therefore, the Cu content is set to 2.00% or less. The Cu content is preferably 1.50% or less or 1.00% or less.

As described above, Cr has an action of enhancing the hardenability of the steel sheet and an action of stabilizing residual austenite. In order to more reliably obtain the effect by the action, the Cr content is preferably set to 0.01% or more or 0.05% or more. However, when the Cr content is more than 2.00%, the chemical convertibility of the steel sheet significantly deteriorates. Therefore, the Cr content is set to 2.00% or less.

As described above, Mo has an action of enhancing the hardenability of the steel sheet and an action of precipitating a carbide in steel to increase the strength. In order to more reliably obtain the effect by the action, the Mo content is preferably set to 0.01% or more or 0.02% or more. However, even when the Mo content is set to more than 1.00%, the effect by the action is saturated, which is not economically preferable. Therefore, the Mo content is set to 1.00% or less. The Mo content is preferably 0.50% or less and 0.20% or less.

As described above, Ni has an action of enhancing the hardenability of the steel sheet. In addition, when Cu is contained, Ni has an action of effectively suppressing the grain boundary cracking of the slab caused by Cu. In order to more reliably obtain the effect by the action, the Ni content is preferably set to 0.02% or more. Since Ni is an expensive element, it is not economically preferable to contain a large amount of Ni. Therefore, the Ni content is set to 2.00% or less.

As described above, B has an action of enhancing the hardenability of the steel sheet. In order to more reliably obtain the effect by the action, the B content is preferably set to 0.0001% or more or 0.0002% or more. However, when the B content is more than 0.0100%, the formability of the steel sheet significantly deteriorates, and thus the B content is set to 0.0100% or less. The B content is preferably 0.0050% or less.

(1-11) Ca: 0.0005% to 0.0200%, Mg: 0.0005% to 0.0200%, REM: 0.0005% to 0.1000%, and Bi: 0.0005% to 0.020%

All of Ca, Mg, and REM have an action of enhancing the formability of the steel sheet by adjusting the shape of an inclusion to a preferable shape. In addition, Bi has an action of enhancing the formability of the steel sheet by refining a solidification structure. Therefore, one or two or more of these elements may be contained. In order to more reliably obtain the effect by the action, it is preferable to contain 0.0005% or more of any one or more of Ca, Mg. REM, and Bi. However, when the Ca content or the Mg content exceeds 0.0200% or when the REM content exceeds 0.1000%, inclusions are excessively formed in steel, and thus the ductility of the steel sheet may be conversely degraded in some cases. In addition, even when the Bi content is set to more than 0.020%, the above effect by the action is saturated, which is not economically preferable. Therefore, the Ca content and the Mg content are set to 0.0200% or less, the REM content is set to 0.1000% or less, and the Bi content is set to 0.020% or less. The Bi content is preferably 0.010% or less.

Here, REM refers to a total of 17 elements consisting of Sc, Y, and lanthanoids, and the REM content refers to a total amount of these elements. In the case of the lanthanoids, the lanthanoids are industrially added in the form of misch metal.

(1-12) One or two or more of Zr, Co, Zn, or W: 0% to 1.00% in total and Sn: 0% to 0.050%

Regarding Zr, Co, Zn, and W, the present inventors have confirmed that, even when a total of 1.00% or less of these elements are contained, the effect of the hot-rolled steel sheet according to the present embodiment is not impaired. Therefore, one or two or more of Zr, Co, Zn, or W may be contained in a total of 1.00% or less.

In addition, the present inventors are confirming that, even when a small amount of Sn is contained, the effect of the hot-rolled steel sheet according to the present embodiment is not impaired; however a defect may occur during hot rolling, and thus the Sn content is set to 0.050% or less.

The chemical composition of the above hot-rolled steel sheet may be measured by a general analytical method. For example, inductively coupled plasma-atomic emission spectrometry (ICP-AES) may be used for measurement. sol. Al may be measured by the ICP-AES using a filtrate after a sample is decomposed with an acid by heating. C and S may be measured by using a combustion-infrared absorption method, and N may be measured by using the inert gas melting-thermal conductivity method. O may be measured by using an inert gas melting-non-dispersive infrared absorption method.

2. Microstructure of Hot-Rolled Steel Sheet

Next, the microstructure of the hot-rolled steel sheet according to the present embodiment will be described.

In the hot-rolled steel sheet according to the present embodiment, in a microstructure, by area %, ferrite is less than 15.0%, residual austenite is less than 3.0%, $L_{52}/L_7$, which is a ratio of a length $L_{52}$ of a grain boundary having a crystal orientation difference of 52° to a length $L_7$ of a grain boundary having a crystal orientation difference of 7° about a <110> direction is 0.10 to 0.18, and a standard deviation of a Mn concentration is 0.60 mass % or less. Therefore, the hot-rolled steel sheet according to the present embodiment can obtain excellent strength, ductility, and shearing workability. In the present embodiment, the microstructure is specified at a ¼ position of a sheet thickness from a surface and a center position in a sheet width direction in a cross section parallel to a rolling direction. The reason therefor is that the microstructure at this position indicates a typical microstructure of the steel sheet. The "¼ position" of the sheet thickness is an observation position for specifying the microstructure and is not strictly limited to a ¼ depth. A microstructure obtained by observing somewhere in a range of ⅛ to ⅜ depth of the sheet thickness can be regarded as the microstructure at the ¼ position.

(2-1) Area Fraction of Ferrite: Less than 15.0%

Ferrite is a structure formed when fcc transforms into bcc at a relatively high temperature. Since ferrite has low strength, when the area fraction of the ferrite is excessive, a desired tensile strength cannot be obtained. In addition, when the area fraction of the ferrite is excessive, the standard deviation of Vickers hardness becomes high. Therefore, the area fraction of the ferrite is set to less than 15.0%. The area fraction of the ferrite is preferably 10.0% or less and more preferably less than 5.0%. When the area ratio of the ferrite is set to 10.0% or less and the standard deviation of Vickers hardness is controlled as described later, it is possible to improve the workability of the end surface of the hot-rolled steel sheet after shearing working.

Since ferrite is preferably as little as possible, the area fraction of the ferrite may be 0%.

Measurement of the area fraction of the ferrite is conducted by the following method. The cross section perpendicular to the rolling direction is mirror-finished and, furthermore, polished at a room temperature with colloidal silica not containing an alkaline solution for 8 minutes, thereby removing strain introduced into a surface layer of a sample. In a random position of the sample cross section in a longitudinal direction, a region with a length of 50 μm and between a depth of ⅛ of the sheet thickness from the surface to a depth of ⅜ of the sheet thickness from the surface is measured by electron backscatter diffraction at a measurement interval of 0.1 μm to obtain crystal orientation information. For the measurement, an EBSD analyzer configured of a thermal field emission scanning electron microscope (JSM-7001F manufactured by JEOL) and an EBSD detector (DVC5 type detector manufactured by TSL) is used. At this time, the degree of vacuum inside the EBSD analyzer is set to $9.6\times10^{-5}$ Pa or less, the acceleration voltage is set to 15 kV, the irradiation current level is set to 13, and the electron beam irradiation level is set to 62. A region where a Grain Average Misorientation value is 1.0° or less is determined as ferrite, using the obtained crystal orientation information and a "Grain Average Misorientation" function installed in the software "OIM Analysis (registered trademark)" attached to the EBSD analyzer. The area fraction of the region determined as the ferrite is obtained, thereby obtaining the area fraction of the ferrite.

(2-2) Area Fraction of Residual Austenite: Less than 3.0%

Residual austenite is a microstructure that is present as a face-centered cubic lattice even at room temperature. Residual austenite has an action of enhancing the ductility of the hot-rolled steel sheet by transformation-induced plasticity (TRIP). On the other hand, residual austenite transforms into high-carbon martensite (hereinafter, also referred to as high-carbon martensite) during shearing working and thus has an action of inhibiting stable crack generation and also causes the localization of damage on a sheared end surface. The damage generated by shearing working is distributed on the worked face, and the difference in the degree of damage results in the presence of a part where austenite transforms into high-carbon martensite and a part where austenite does not transform. As a result, in a more significantly damaged portion in the damage distribution, the generated full hard high-carbon martensite acts to promote damage, and thus damage on the sheared end surface is further localized. When the area fraction of the residual austenite is 3.0% or more, the action is actualized, and the workability of the sheared end surface in the hot-rolled steel sheet deteriorates. Therefore, the area fraction of the residual austenite is set to less than 3.0%. The area fraction of the residual austenite is preferably less than 1.0%. Since residual austenite is preferably as little as possible, the area fraction of the residual austenite may be 0%.

As the measurement method of the area fraction of the residual austenite, methods by X-ray diffraction, electron back scatter diffraction image (EBSP, electron back scattering diffraction pattern) analysis, and magnetic measurement and the like may be used and the measured values may differ depending on the measurement method. In the present embodiment, the area fraction of the residual austenite is measured by X-ray diffraction.

In the measurement of the area fraction of the residual austenite by X-ray diffraction in the present embodiment, first, the integrated intensities of a total of 6 peaks of α(110), α(200), α(211), γ(111), γ(200), and γ(220) are obtained in the cross section parallel to the rolling direction at the ¼ position of the sheet thickness of the steel sheet and the center position in the sheet width direction using Co-Kα rays, and the area fraction of the residual austenite is obtained by calculation using the strength averaging method.

(2-3) Bainite, Martensite, and Auto-Tempered Martensite: More than 82.0% and 100.0% or Less in Total In the hot-rolled steel sheet according to the present embodiment, a low-temperature structure is contained as a microstructure other than the ferrite and the residual austenite. The low-temperature structure in the present embodiment is a structure consisting of martensite, bainite and auto-tempered martensite in a total area fraction of more than 82.0% and 100.0% or less. When the total area fraction of the bainite, the martensite, and the auto-tempered martensite is 82.0% or less, there is a concern that it may not be possible to obtain a desired strength. Therefore, the total area fraction of the bainite and the martensite is preferably set to more than 82.0%. The total area fraction is more preferably 85.0% or more. The total area fraction of the bainite, the martensite, and the auto-tempered martensite is preferably as large as possible and thus may be set to 100.0%.

As the low-temperature structure, one of the bainite, the martensite, and the auto-tempered martensite may be contained in an area fraction of more than 82.0% and 100.0% or less or two or more of the bainite, the martensite, and the auto-tempered martensite may be contained in a total area fraction of more than 82.0% and 100.0% or less.

In the microstructure of the hot-rolled steel sheet according to the present embodiment, by area %, the ferrite is less than 15.0%, the residual austenite is less than 3.0%, and the above low-temperature structure is contained as the remainder in microstructure. That is, since the microstructure other than the ferrite and the residual austenite is the low-temperature structure consisting of one or two or more of the bainite, the martensite, and the auto-tempered martensite, the area fraction thereof may be obtained by subtracting the total area fraction of the ferrite and the residual austenite from 100.0%. Incidentally, as the measurement method of the area fraction of the low-temperature structure, the following method may be performed using a thermal field emission scanning electron microscope.

In the low-temperature structure, an area ratio of the martensite can be obtained by the following procedure.

A cross section parallel to the rolling direction at the ¼ position of the sheet thickness of the steel sheet and the center position in the sheet width direction is designated as an observed section, and this observed section is etched with LePera liquid. The observed section is regarded as a sheet thickness cross section parallel to the rolling direction of the steel sheet. A secondary electron image of a 100 μm×100 μm region within a range of ⅛ to ⅜ of the sheet thickness, in which ¼ of the sheet thickness is centered, in the observed section obtained with a thermal field emission scanning electron microscope (JSM-7001F manufactured by JEOL) is observed. Since martensite and residual austenite are not corroded by LePera corrosion, an area ratio of uncorroded regions can be regarded as a total area ratio of the martensite and the residual austenite. The area ratio of the martensite can be calculated by subtracting the area ratio of the residual austenite measured by the above method from the area ratio of these uncorroded regions.

In addition, in the low-temperature structure, an area ratio of the bainite and the auto-tempered martensite can be, similar to the above measurement method of the area fraction of the martensite, determined from a secondary electron image obtained by observation with the thermal field emission scanning electron microscope (JSM-7001F manufactured by JEOL). An observed section is polished and Nital-etched, and a 100 μm×100 μm region within a range of ⅛ to ⅜ of the sheet thickness, in which ¼ of the sheet thickness is centered, on the observed section is observed. A plurality of indentations are left around the region observed by the above LePera corrosion, whereby the same region as the region observed by the LePera corrosion can be confirmed.

Auto-tempered martensite is an aggregate of lath-shaped crystal grains and is a structure in which an iron carbide has two or more extending directions. Incidentally, bainite is also an aggregate of lath-shaped crystal grains, but is a structure in which an iron-based carbide having a major axis of 20 nm or more is not contained or a structure in which an iron-based carbide having a major axis of 20 nm or more is contained and the carbide is a single variant, that is, has one extending direction of the iron-based carbide group. Auto-tempered martensite can be distinguished from bainite due to the fact that cementite in the structure has a plurality of variants.

The area fractions of the bainite, the martensite, and the auto-tempered martensite, which are the low-temperature structure, may be obtained by the above-described method in which a thermal field emission scanning electron microscope is used.

As described above, in the microstructure of the hot-rolled steel sheet according to the present embodiment, less than 15.0% of the ferrite and less than 3.0% of the residual austenite are contained, the remainder in microstructure substantially consists of the low-temperature structure, and, in addition to these structures, pearlite may be contained. Pearlite is a lamellar microstructure in which cementite is precipitated in layers between ferrite and is a soft microstructure as compared with bainite and martensite. Pearlite is a structure that has a low strength and degrades the ductility and is thus preferable not contained in the hot-rolled steel sheet according to the present embodiment. In addition, even when pearlite is contained, the area fraction is preferably 5% or less by area % from the viewpoint of securing the strength and the ductility. The area fraction is more preferably 3% or less. Since pearlite is preferably as little as possible, the area fraction of the pearlite may be 0%.

The area fraction of the pearlite can be measured by the following method. A test piece is sampled from the steel sheet such that the microstructure of a sheet thickness cross section parallel to the rolling direction at a ¼ depth of the sheet thickness from the surface (a region of a ⅛ depth of the sheet thickness from the surface to a ⅜ depth of the sheet thickness from the surface) can be observed. Next, the sheet thickness cross section is polished, then, the polished surface is Nital-etched, and the structures of at least three 30 μm×30 μm regions are observed using an optical microscope and a scanning electron microscope (SEM). The area ratio of the pearlite is obtained by performing image analysis on a structure photograph obtained by this structure observation.

When the pearlite is present, the above measurement of the area fraction of the ferrite is performed on crystal grains excluding crystal grains determined as pearlite. Specifically, a region where a Grain Average Misorientation value is 1.0° or less is determined as ferrite, using the obtained crystal orientation information and a "Grain Average Misorientation" function installed in the software "OIM Analysis (registered trademark)" attached to the EBSD analyzer. The area fraction of the region determined as the ferrite is obtained, thereby obtaining the area fraction of the ferrite.

(2-4) $L_{52}/L_7$ Ratio of Length $L_{52}$ of Grain Boundary Having Crystal Orientation Difference of 52° to Length $L_7$ of Grain Boundary Having Crystal Orientation Difference of 7° about ≤110> Direction: 0.10 to 0.18

In order to obtain a high strength of 980 MPa or more, the primary phase is required to have a full hard structure. The full hard structure is generally formed in a phase transformation at 600° C. or lower, but in this temperature range, a large number of a grain boundary having a crystal orientation difference of 52° and a grain boundary having a crystal orientation difference of 7° about the <110> direction are formed. When forming the grain boundary having a crystal orientation difference of 7° about the <110> direction, dislocations are less likely to accumulate in a hard phase. Therefore, in a microstructure in which such a grain boundary is uniformly dispersed at a high density (that is, the total length of such a grain boundary is large), introduction of dislocations into the microstructure by shearing working is easy, and distortion of a material during shearing working is promoted. As a result, the height difference of the end surface after shearing working is suppressed.

On the other hand, in the grain boundary having a crystal orientation difference of 52° about the <110> direction, dislocations are likely to accumulate in the hard phase. Therefore, introduction of dislocations into the microstructure by shearing working is difficult, and a material immediately fractures during shearing working, and thus the height difference of the end surface after shearing working becomes large. Therefore, when the length of the grain boundary having a crystal orientation difference of 52° is indicated by $L_{52}$ and the length of the grain boundary having a crystal orientation difference of 7° about the <110> direction is indicated by $L_7$, the height difference of the end surface after shearing working is dominated by $L_{52}/L_7$. When $L_{52}/L_7$ is less than 0.10, since it is extremely difficult for dislocation to accumulate in the hard phase, it is not possible to set the strength of the base metal to 980 MPa or more. In addition, when $L_{52}/L_7$ is more than 0.18, the height difference of the end surface after shearing working becomes large. Therefore, in order to reduce the height difference of the end surface after shearing working, $L_{52}/L_7$ is set to 0.10 to 0.18. $L_{52}/L_7$ is preferably 0.12 or more or 0.13 or more. In addition, $L_{52}/L_7$ is preferably 0.16 or less and 0.15 or less.

A grain boundary having a crystal orientation difference of X° about the <110> direction refers to a grain boundary having a crystallographic relationship in which the crystal orientations of a crystal grain A and a crystal grain B are the same by rotating one crystal grain B by X° along the <110> axis, when two adjacent crystal grains (the crystal grain A and the crystal grain B) at a certain grain boundary are specified. However, considering the measurement accuracy of the crystal orientation, an orientation difference of +4° from the matching orientation relationship is allowed.

In the present embodiment, the length $L_{52}$ of the grain boundary having a crystal orientation difference of 52° and the length $L_7$ of the grain boundary having a crystal orientation difference of 7° about the <110> direction are measured by using the electron back scatter diffraction pattern-orientation image microscopy (EBSP-OIM) method.

In the EBSP-OIM method, first, a highly inclined sample is irradiated with electron beams in a scanning electron microscope (SEM), and a Kikuchi pattern formed by back-scattering is photographed with a high-sensitivity camera. Next, the obtained photographed image is processed with a computer, whereby a crystal orientation of an irradiation point can be measured for a short time period.

The EBSP-OIM method is performed using an EBSD analyzer configured of a scanning electron microscope (JSM-7001F manufactured by JEOL) and an EBSD detector and OIM Analysis (registered trademark) manufactured by AMETEK, Inc. In the EBSP-OIM method, since the fine structure of the sample surface and the crystal orientation can be analyzed, the length of the grain boundary having a specific crystal orientation difference can be quantitatively obtained. In addition, the analyzable area of the EBSP-OIM method is a region that can be observed with the SEM. The EBSP-OIM method makes it possible to analyze a region with a minimum resolution of 20 nm, which varies depending on the resolution of the SEM.

$L_{52}$ of the present embodiment is calculated by the following method.

The length of the grain boundary having a crystal orientation difference of 52° about the <110> direction is measured at the ¼ position of the sheet thickness from the surface of the steel sheet and the center position in the sheet width direction in a cross section parallel to the rolling direction. In this measurement, analysis is performed in at least 5 visual fields in a 40 μm×30 μm region at a magnification of 1200 times, and the average value of the lengths of grain boundaries having a crystal orientation difference of 52° about the <110> direction is calculated, thereby obtaining $L_{52}$.

Similarly, an average value of the lengths of grain boundaries having a crystal orientation difference of 7° about the <110> direction is calculated to obtain $L_7$. As described above, when calculating $L_{52}$ and $L_7$, an orientation difference of ±4° is allowed.

Ferrite is a soft phase and has a small influence on a dislocation accumulation effect inside the hard phase. In addition, residual austenite is not a structure formed by a phase transformation at 600° C. or lower and has no effect of dislocation accumulation. Therefore, in the present measurement method, ferrite and residual austenite are not included as a target in the analysis. Ferrite can be specified and excluded from the analysis target by the same method as the measurement method of the area fraction of the ferrite. In the EBSP-OIM method, residual austenite having an fcc crystal structure can be excluded from the analysis target.

(2-5) Standard Deviation of Mn Concentration: 0.60 Mass % or Less

The standard deviation of the Mn concentration at the ¼ position of the sheet thickness from the surface of the hot-rolled steel sheet according to the present embodiment and the center position in the sheet width direction is 0.60 mass % or less. Accordingly, the grain boundary having a crystal orientation difference of 7° about the <110> direction can be uniformly dispersed. As a result, the height difference of the end surface after shearing working can be reduced. The standard deviation of the Mn concentration is preferably 0.55 mass % or less, 0.50 mass % or less, or 0.40 mass % or less.

From the viewpoint of suppressing the unevenness of the end surface after shearing working, the standard deviation of the Mn concentration is desirably as small as possible. However, from the viewpoint of restrictions on the manufacturing process, the practical lower limit of the standard deviation of the Mn concentration may be set to 0.10 mass % or more.

The standard deviation of the Mn concentration of the present embodiment is calculated by the following method.

After an L cross section (cross section parallel to the rolling direction) of the hot-rolled steel sheet is mirror polished, the ¼ position of the sheet thickness from the surface of the steel sheet and the center position in the sheet width direction is measured with an electron probe micro-analyzer (EPMA) to measure the standard deviation of the Mn concentration. As the measurement conditions, the acceleration voltage is set to 15 kV, and the magnification is set to 5000 times. The measurement range is set to a range that is 20 μm in the sample rolling direction and 20 μm in the sample sheet thickness direction, and a distribution image is measured. More specifically, the measurement interval is set to 0.1 μm, and the Mn concentrations at 40000 or more points are measured. Next, the standard deviation is calculated based on the Mn concentrations obtained from all of the measurement points. Therefore, the standard deviation of the Mn concentration is obtained.

(2-6) Standard Deviation of Vickers Hardness: 20 HV0.01 or Less

When the standard deviation of Vickers hardness at the center position in the sheet width direction is set to 20 HV0.01 or less and the area fraction of the ferrite is set to 10.0% or less as described above in a sheet thickness cross section parallel to the rolling direction of the hot-rolled steel sheet, it is possible to improve the workability of the end surface of the hot-rolled steel sheet after shearing working. The workability of the end surface after shearing working is significantly degraded by damage to the end surface by shearing working. In particular, the damage to the end surface generated by shearing working is distributed in the sheet thickness direction, and the degree of damage is localized in a part in the sheet thickness direction, that is, a part in the sheet thickness direction is significantly damaged. Particularly, when additional working is performed on to the end surface after shearing working, it is presumed that the significantly damaged portion becomes a source of cracking and leads to fracture.

The present inventors found that, as the amount of the ferrite decreases and the standard deviation of Vickers hardness decreases, the localization of damage in the sheet thickness direction to the end surface after shearing working decreases, and the workability of the end surface after shearing working further improves. This is considered to be because the structure of the hot-rolled steel sheet becomes uniform, whereby the generation of voids during shearing working is suppressed and the localization of damage can be decreased. In order to obtain the above action, the standard deviation of Vickers hardness distribution of the hot-rolled steel sheet is preferably set to 20 HV0.01 or less. The standard deviation is more preferably 18 HV0.01 or less and 17 HV0.01 or less.

The standard deviation of Vickers hardness is obtained by the following method.

In the microstructure at the center position in the sheet width direction on a sheet thickness cross section parallel to the rolling direction, Vickers hardness is measured at equal intervals at 300 or more measurement points within a range of the sheet thickness×1 mm. The measured load is set to 10 gf. Based on the measurement results, the standard deviation of Vickers hardness (HV0.01) is calculated.

3. Tensile Strength Properties

In the hot-rolled steel sheet according to the present embodiment, the tensile (maximum) strength is 980 MPa or more. When the tensile strength is less than 980 MPa, an applicable component is limited, and the contribution to vehicle body weight reduction is small. The upper limit does not need to be particularly limited and may be set to 1780 MPa from the viewpoint of suppressing the wearing of a die. The tensile strength is measured according to JIS Z 2241: 2011 using a No. 5 test piece of JIS Z 2241: 2011. The sampling position of the tensile test piece may be a ¼ portion from the end portion in the sheet width direction, and the tensile test piece may be sampled such that a direction perpendicular to the rolling direction becomes the longitudinal direction.

4. Sheet Thickness

The sheet thickness of the hot-rolled steel sheet according to the present embodiment is not particularly limited and may be 0.5 to 8.0 mm. By setting the sheet thickness of the hot-rolled steel sheet to 0.5 mm or more, it becomes easy to secure a rolling completion temperature, and a rolling force can be reduced, and thus it is possible to easily perform hot rolling. Therefore, the sheet thickness of the hot-rolled steel sheet according to the present embodiment may be set to 0.5 mm or more. The sheet thickness is preferably 1.2 mm or more and 1.4 mm or more. In addition, when the sheet thickness is set to 8.0 mm or less, the refinement of the microstructure becomes easy, and the above-described microstructure can be easily secured. Therefore, the sheet thickness may be set to 8.0 mm or less. The sheet thickness is preferably 6.0 mm or less.

5. Others (5-1) Plating Layer

The hot-rolled steel sheet according to the present embodiment having the above-described chemical composition and microstructure may be a surface-treated steel sheet provided with a plating layer on the surface for the purpose of improving corrosion resistance and the like. The plating layer may be an electro plating layer or a hot-dip plating layer. Examples of the electro plating layer include electrogalvanizing, electro Zn—Ni alloy plating, and the like. Examples of the hot-dip plating layer include hot-dip galvanizing, hot-dip galvannealing, hot-dip aluminum plating, hot-dip Zn—Al alloy plating, hot-dip Zn—Al—Mg alloy plating, hot-dip Zn—Al—Mg—Si alloy plating, and the like. The plating adhesion amount is not particularly limited and may be the same as before. Further, it is also possible to further enhance the corrosion resistance by performing an appropriate chemical conversion treatment (for example, the application and drying of a silicate-based chromium-free chemical conversion treatment liquid) after plating.

6. Manufacturing Conditions

A suitable method for manufacturing the hot-rolled steel sheet according to the present embodiment having the above-described chemical composition and microstructure is as follows.

In order to obtain the hot-rolled steel sheet according to the present embodiment, it is effective to perform hot rolling after heating a slab under predetermined conditions, to perform accelerated cooling to a predetermined temperature range after hot rolling, and to control the cooling history after coiling.

In the suitable method for manufacturing the hot-rolled steel sheet according to the present embodiment, the following steps (1) to (7) are sequentially performed. The temperature of the slab and the temperature of the steel sheet in the present embodiment refer to the surface temperature of the slab and the surface temperature of the steel sheet.

(1) The slab is held in a temperature range of 700° C. to 850° C. for 900 seconds or longer, then further heated, and retained in a temperature range of 1100° C. or higher for 6000 seconds or longer.

(2) Hot rolling is performed in a temperature range of 850° C. to 1100° C. so that the sheet thickness is reduced by a total of 90% or more.

(3) The hot rolling is completed at a temperature T1 (° C.), which is represented by the following formula <1>, or higher.

(4) Cooling is started within 1.5 seconds after the completion of the hot rolling, and accelerated cooling is performed at an average cooling rate of 50° C./second or faster to a temperature T2 (° C.), which is represented by the following formula <2>, or lower.

(5) Cooling is performed from the cooling stop temperature of the accelerated cooling to the coiling temperature at an average cooling rate of 10° C./second or faster.

(6) Coiling is performed at a temperature T3 (° C.), which is represented by the following formula <3>, or higher.

(7) In cooling after the coiling, the cooling is performed so that, in the predetermined temperature ranges of the endmost portion in the sheet width direction and the center portion in the sheet width direction of the hot-rolled steel sheet, the lower limit of the holding time after coiling satisfies a condition I (any one or more of longer than 2000 seconds at 450° C. or higher, longer than 8000 seconds at 400° C. or higher, and longer than 30000 seconds at 350° C. or higher). More preferably, the average cooling rate in a temperature range from the coiling temperature to the coiling temperature −10° C. is set to 0.010° C./second or slower.

$$T1\ (°\ C.)=868-396\times[C]-68.1\times[Mn]+24.6\times[Si]-36.1\times[Ni]-24.8\times[Cr]-20.7\times[Cu]+250\times[sol.\ Al] \quad <1>$$

$$T2\ (°\ C.)=770-270\times[C]-90\times[Mn]-37\times[Ni]-70\times[Cr]-83\times[Mo] \quad <2>$$

$$T3\ (°\ C.)=591-474\times[C]-33\times[Mn]-17\times[Ni]-17\times[Cr]-21\times[Mo] \quad <3>$$

However, the [element symbol] in each formula indicates the amount (mass %) of each element in the steel. When the element is not contained, substitution is performed with 0.

(6-1) Slab, Slab Temperature when Subjected to Hot Rolling, Holding and Retention Time As the slab to be subjected to hot rolling, a slab obtained by continuous casting, a slab obtained by casting and blooming, and the like can be used. If necessary, a slab obtained by additionally performing hot working or cold working on the above-described slab can be used.

It is effective that the slab to be subjected to hot rolling is held in a temperature range of 700° C. to 850° C. during heating for 900 seconds or longer, then further heated and retained in a temperature range of 1100° C. or higher for 6000 seconds or longer. During holding in the temperature range of 700° C. to 850° C., the steel sheet temperature may be fluctuated or be maintained constant in this temperature range. Furthermore, during retaining in the temperature range of 1100° C. or higher, the steel sheet temperature may be fluctuated or be maintained constant at 1100° C. or higher.

In the austenite transformation in the temperature range of 700° C. to 850° C. when Mn is diffused between the ferrite and the austenite and the transformation time becomes longer, Mn can be diffused in the ferrite region. Accordingly, the Mn microsegregation unevenly distributed in the slab can be eliminated, and the standard deviation of the Mn concentration can be significantly reduced. By reducing the standard deviation of the Mn concentration, it is possible to uniformly disperse the grain boundaries having a crystal orientation difference of 7° about the <110> direction in the final microstructure and to reduce the height difference of the end surface after shearing working. Further, in order to make the austenite grains uniform during slab heating, it is effective to heat the slab in the temperature range of 1100° C. or higher for 6000 seconds or longer.

In hot rolling, it is preferable to use a reverse mill or a tandem mill for multi-pass rolling. Particularly, from the viewpoint of industrial productivity, it is more preferable that at least the final several stages are subjected to hot rolling using a tandem mill.

(6-2) Rolling Reduction of Hot Rolling: Total Sheet Thickness Reduction of 90% or More in Temperature Range of 850° C. to 1100° C.

Hot rolling is performed in a temperature range of 850° C. to 1100° C. so that the sheet thickness is reduced by a total of 90% or more. This refines mainly the recrystallized austenite grains. Furthermore, the accumulation of strain energy in the unrecrystallized austenite grains is promoted, whereby the recrystallization of austenite is promoted, the atomic diffusion of Mn is promoted, and, as a result, the standard deviation of the Mn concentration can be reduced. Therefore, it is effective to perform the hot rolling in a temperature range of 850° C. to 1100° C. so that the sheet thickness is reduced by a total of 90% or more. That is, in the present embodiment, the standard deviation of the Mn concentration cannot be sufficiently suppressed only by the precise control of slab heating, but can be suppressed by controlling the rolling reduction of the hot rolling to be within the above range.

The sheet thickness reduction in a temperature range of 850° C. to 1100° C. can be expressed as $(t_0-t_1)/t_0\times100(\%)$ when an inlet sheet thickness before a first pass in a rolling in this temperature range is to and an outlet sheet thickness after a final pass in the rolling in this temperature range is $t_1$.

(6-3) Hot Rolling Completion Temperature: T1 (° C.) or Higher

The hot rolling completion temperature is preferably set to T1 (° C.) or higher. By setting the hot rolling completion temperature to T1 (° C.) or higher, it is possible to suppress an excessive increase in the number of ferrite nucleation sites in austenite. Furthermore, as a result, the formation of ferrite in the final structure (the microstructure of the hot-rolled steel sheet after manufacturing) is suppressed, and a high-strength steel sheet can be obtained.

(6-4) Accelerated Cooling after Completion of Hot Rolling: Starting Cooling within 1.5 Seconds and Accelerated Cooling to T2 (° C.) or Lower at Average Cooling Rate of 50° C./Second or Faster In order to suppress the growth of austenite crystal grains refined by hot rolling, it is preferable to perform accelerated cooling to T2 (° C.) or lower within 1.5 seconds after the completion of hot rolling at an average cooling rate of 50° C./second or faster.

By performing accelerated cooling to T2 (° C.) or lower within 1.5 seconds after the completion of hot rolling at the average cooling rate of 50° C./second or faster, the formation of ferrite and pearlite can be suppressed. Accordingly, the strength of the steel sheet is enhanced. The average cooling rate referred herein is a value obtained by dividing the temperature drop width of the steel sheet from a start of accelerated cooling (when introducing the steel sheet into cooling equipment) to the completion of accelerated cooling (when retrieving the steel sheet from the cooling equipment) by the time required from the start of accelerated cooling to the completion of accelerated cooling. In the accelerated cooling after the completion of hot rolling, when the time to start cooling is set to 1.5 seconds or shorter, the average cooling rate is set to 50° C./second or faster, and the cooling stop temperature is set to T2 (° C.) or lower, ferritic transformation and/or pearlitic transformation inside the steel sheet can be suppressed, and TS≥980 MPa can be obtained. Therefore, within 1.5 seconds after the completion of hot rolling, the accelerated cooling is performed to T2 (° C.) or lower at the average cooling rate of 50° C./second or faster. The upper limit of the average cooling rate is not particularly specified, but when the cooling rate is increased, the cooling equipment becomes large and the equipment cost increases. Therefore, considering the equipment cost, the average cooling rate is preferably 300° C./second or slower, more preferably slower than 200° C./second, and still more preferably 150° C./second or slower. In addition, the cooling stop temperature of the accelerated cooling may be set to T3 (° C.) or higher.

(6-5) Average Cooling Rate from Cooling Stop Temperature of Accelerated Cooling to Coiling Temperature: 10° C./Second or Faster In order to suppress the area fraction of the pearlite and obtain a tensile strength of 980 MPa or more, the average cooling rate from the cooling stop temperature of the accelerated cooling to the coiling temperature is set to 10° C./second or faster. In such a case, the primary phase structure can be made full hard. The average cooling rate referred herein refers to a value obtained by dividing a temperature drop width of the steel sheet from the cooling stop temperature of the accelerated cooling to the coiling temperature by the time required from the stop of the accelerated cooling to coiling. By setting the average cooling rate to 10° C./second or faster, it is possible to reduce the area fraction of the pearlite and to secure the strength and the ductility. Therefore, the average cooling rate from the cooling stop temperature of the accelerated cooling to the coiling temperature is set to 10° C./second or faster.

(6-6) Coiling Temperature: T3 (° C.) or Higher

The coiling temperature is set to T3 (° C.) or higher. When setting the coiling temperature to T3 (° C.) or higher, it is possible to decrease the transformation driving force from austenite to bcc and it is also possible to decrease the deformation strength of austenite. Therefore, at the time of bainitic or martensitic transformation, $L_{52}/L_7$ can be set to 0.18 or less by reducing the length $L_{52}$ of the grain boundary having a crystal orientation difference of 52° about the <110> direction or increasing the length $L_7$ of the grain boundary having a crystal orientation difference of 7° about the <110> direction. As a result, the height difference of the end surface after shearing working can be reduced. Therefore, the coiling temperature is set to T3 (° C.) or higher.

(6-7) Cooling after Coiling: After Coiling of Hot-Rolled Steel Sheet, Cooling in Predetermined Temperature Range for Lower Limit of Holding Time to Satisfy Following Condition I Condition I: Any one or more of longer than 2000 seconds at 450° C. or higher, longer than 8000 seconds at 400° C. or higher, and longer than 30000 seconds at 350° C. or higher In the cooling after the coiling, cooling is performed so that the lower limit of the holding time in a predetermined temperature range satisfies the condition I, that is, cooling is performed with a holding time satisfying any one or more of longer than 2000 seconds at 450° C. or higher, longer than 8000 seconds at 400° C. or higher, and longer than 30000 seconds at 350° C. or higher secured, whereby transformation progresses sufficiently. As the transformation progresses, austenite may be stabilized and the transformation may stop: however, if this holding time is satisfied, the transformation resumes, and the area fraction of residual austenite can be reduced. As a result, it is possible to set the area fraction of residual austenite to less than 3.0%.

In addition, in the cooling after the coiling, as a more preferable condition, the average cooling rate in a temperature range of the coiling temperature to the coiling temperature −10° C. is set to 0.010° C./second or slower. In such a case, it is possible to make the transformation formation temperature in the microstructure uniform. As a result, it is possible to set the standard deviation of Vickers hardness of the hot-rolled steel sheet to 20 HV0.01 or less and to improve the workability of the end surface after shearing working.

The cooling rate of the hot-rolled steel sheet after the coiling may be controlled with a heat insulating cover or an edge mask, by mist cooling, or the like.

In the present embodiment, the temperature of the hot-rolled steel sheet is measured with a contact-type or non contact-type thermometer in the endmost portion in the sheet width direction. In portions other than the endmost portion of the hot-rolled steel sheet in the sheet width direction, the temperature is measured with a thermocouple or calculated by heat-transfer analysis.

EXAMPLES

Next, the effects of one aspect of the present invention will be described more specifically by way of examples, but the conditions in the examples are condition examples adopted for confirming the feasibility and effects of the present invention. The present invention is not limited to these condition examples. The present invention can employ various conditions as long as the object of the present invention is achieved without departing from the gist of the present invention.

Steels having a chemical composition shown in Steel Nos. A to T in Table 1 and Table 2 were melted and continuously cast to manufacture slabs having a thickness of 240 to 300 mm. The obtained slabs were used to obtain hot-rolled steel sheets shown in Table 5 under the manufacturing conditions shown in Table 3 and Table 4. The slabs to be subjected to hot rolling were held in a temperature range of 700° C. to 850° C. during heating for a holding time shown in Table 3, then, further heated up to a heating temperature shown in Table 3, and retained.

For the obtained hot-rolled steel sheets, the area fractions of ferrite and residual austenite, $L_{52}/L_7$, the standard deviations of the Mn concentrations, and the standard deviations of Vickers hardness were obtained by the above methods. The obtained measurement results are shown in Table 5.

In the microstructure of present invention examples, as a result of confirmation by a method in which the above thermal field emission scanning electron microscope was used, the structure other than ferrite and residual austenite consisted of one or more of bainite, martensite, and tempered martensite.

[Evaluation Method of Properties of Hot-Rolled Steel Sheets]

(1) Tensile Strength And Total Elongation

Among the mechanical properties of the obtained hot-rolled steel sheets, the tensile strength and the total elongation were evaluated according to JIS Z 2241: 2011. A test piece was a No. 5 test piece of JIS Z 2241: 2011. The sampling position of the tensile test piece was a ¼ portion from the end portion in the sheet width direction, and the tensile test piece was sampled so that a direction perpendicular to a rolling direction became the longitudinal direction.

In a case where the tensile strength TS≥980 MPa and the tensile strength TS×total elongation El≥14000 (MPa·%) were satisfied, the hot-rolled steel sheet was determined as acceptable as a hot-rolled steel sheet having excellent strength and ductility. On the other hand, in a case where any one of the tensile strength TS≥980 MPa and the tensile strength TS×total elongation El≥14000 (MPa·%) was not satisfied, the hot-rolled steel sheet was determined as unacceptable for not having excellent strength and ductility.

(2) Shearing Workability and Workability of End Surface after Shearing Working

The shearing workability of the hot-rolled steel sheet and the workability of the sheared end surface were evaluated by a punching test. Five punched holes were prepared with a hole diameter of 10 mm, a clearance of 10%, and a punching speed of 3 m/s.

First, in the evaluation of the shearing workability, the cross sections of the five punched holes perpendicular to the rolling direction were embedded in a resin, and the cross-sectional shapes were photographed with a scanning electron microscope. In the obtained observation photographs, the worked end surfaces as shown in FIG. 1 could be observed. In the observation photograph, a straight line that was perpendicular to an upper surface and a lower surface of the hot-rolled steel sheet and passed through an apex of a burr (a point A in a burr portion farthest from the lower surface of the hot-rolled steel sheet in the sheet thickness direction) (straight line 1 in FIG. 1) and a straight line that was perpendicular to the upper surface and the lower surface of the hot-rolled steel sheet and passed through a position B in the cross section closest to the punched hole (farthest from the straight line 1) (straight line 2 in FIG. 1) were drawn, and the distance between these two straight lines (d in FIG. 1) was defined as the height difference of the end surface. For 10 end surfaces obtained from the 5 punched holes, the height differences of the end surfaces were measured, and, when a maximum value of the height differences of the end surfaces was 18% or less of the sheet thickness (the maximum value of the height differences of the end surfaces (mm)/the sheet thickness (mm)×100≤18), the hot-rolled steel sheet was determined as acceptable as a hot-rolled steel sheet having excellent shearing workability. On the other hand, when the maximum value of the height differences of the end surfaces was more than 18% of the sheet thickness (the maximum value of the height differences of the end surfaces (mm)/the sheet thickness (mm)×100>18), the hot-rolled steel sheet was determined as unacceptable as a hot-rolled steel sheet having poor shearing workability.

Next, in the evaluation of the workability of the end surface after shearing working. Vickers hardness was measured for the above 10 end surfaces whose cross-sectional shapes were photographed. The load was set to 100 gf, and Vickers hardness (HV0.1) were measured at a position 80 μm from the end surface (a position 80 μm from the straight line 2 toward the straight line 1 side in FIG. 1) from the upper surface to the lower surface of the hot-rolled steel sheet at 100 μm intervals in the sheet thickness direction. When the difference between a maximum value and a minimum value of the obtained Vickers hardness was 85 HV0.1 or less, the hot-rolled steel sheet was determined as a hot-rolled steel sheet having excellent workability of the end surface after shearing working.

The obtained measurement results are shown in Table 5.

TABLE 1

| | Mass %, remainder is Fe and impurity | | | | | | | | |
|---|---|---|---|---|---|---|---|---|---|
| Steel No. | C | Si | Mn | sol. Al | P | S | N | O | Ti |
| A | 0.102 | 1.15 | 2.12 | 0.033 | 0.015 | 0.0023 | 0.0049 | 0.0037 | |
| B | 0.185 | 1.31 | 2.25 | 0.036 | 0.013 | 0.0045 | 0.0059 | 0.0017 | |
| C | 0.245 | 0.99 | 2.14 | 0.034 | 0.015 | 0.0009 | 0.0046 | 0.0024 | |
| D | 0.133 | 0.25 | 2.59 | 0.031 | 0.012 | 0.0043 | 0.0030 | 0.0040 | |
| E | 0.218 | 1.85 | 2.08 | 0.036 | 0.025 | 0.0001 | 0.0020 | 0.0027 | |
| F | 0.195 | 1.44 | 1.12 | 0.036 | 0.025 | 0.0051 | 0.0050 | 0.0032 | |
| G | 0.213 | 0.99 | 3.60 | 0.890 | 0.020 | 0.0011 | 0.0033 | 0.0019 | |
| H | 0.202 | 0.82 | 3.30 | 1.520 | 0.015 | 0.0150 | 0.0032 | 0.0032 | |
| I | 0.132 | 1.36 | 1.89 | 0.034 | 0.013 | 0.0035 | 0.0030 | 0.0015 | |
| J | 0.186 | 0.86 | 2.04 | 0.033 | 0.019 | 0.0047 | 0.0026 | 0.0015 | 0.150 |
| K | 0.132 | 1.27 | 2.11 | 0.024 | 0.020 | 0.0033 | 0.0051 | 0.0018 | |
| L | 0.143 | 1.23 | 1.94 | 0.030 | 0.019 | 0.0060 | 0.0057 | 0.0011 | |
| M | 0.201 | 1.09 | 2.14 | 0.023 | 0.022 | 0.0002 | 0.0028 | 0.0028 | |
| N | 0.132 | 1.23 | 1.99 | 0.023 | 0.019 | 0.0049 | 0.0029 | 0.0015 | |
| O | 0.166 | 0.81 | 1.90 | 0.028 | 0.022 | 0.0032 | 0.0037 | 0.0018 | |
| P | 0.167 | 1.18 | 2.06 | 0.033 | 0.022 | 0.0053 | 0.0034 | 0.0038 | |
| Q | 0.078 | 1.25 | 2.04 | 0.020 | 0.022 | 0.0036 | 0.0052 | 0.0031 | |
| R | 0.274 | 1.43 | 2.16 | 0.038 | 0.025 | 0.0030 | 0.0052 | 0.0021 | |
| S | 0.183 | 2.51 | 2.11 | 0.024 | 0.024 | 0.0017 | 0.0050 | 0.0015 | |
| T | 0.142 | 1.26 | 0.85 | 0.037 | 0.015 | 0.0015 | 0.0046 | 0.0023 | |

| | Mass %, remainder is Fe and impurity | | | | | | | |
|---|---|---|---|---|---|---|---|---|
| Steel No. | Nb | V | Cu | Cr | Mo | Ni | B | Note |
| A | | | | | | | | Invention Example |
| B | | | | | | | | Invention Example |
| C | | | | | | | | Invention Example |
| D | | | | | | | | Invention Example |
| E | | | | | | | | Invention Example |
| F | | | | | | | | Invention Example |
| G | | | | | | | | Invention Example |
| H | | | 0.01 | 0.21 | | 0.01 | | Invention Example |
| I | 0.018 | | | | | | | Invention Example |
| J | | | | | | | | Invention Example |
| K | | 0.050 | | | | | | Invention Example |
| L | | 0.042 | 0.02 | | | | | Invention Example |
| M | | | | 0.34 | | | | Invention Example |
| N | | | | | 0.18 | | | Invention Example |

TABLE 1-continued

| | | | | | | | | | | |
|---|---|---|---|---|---|---|---|---|---|---|
| O | | | | | | 0.34 | | | | Invention Example |
| P | | | | | | | 0.0022 | | | Invention Example |
| Q | | | | | | | | | | Comparative Example |
| R | | | | | | | | | | Comparative Example |
| S | | | | | | | | | | Comparative Example |
| T | | | | | | | | | | Comparative Example |

Underlines indicate that the corresponding values are outside the ranges of the present invention.

TABLE 2

| Steel | Mass %, remainder is Fe and impurity | | | | | | | | | T1 | T2 | T3 | |
|---|---|---|---|---|---|---|---|---|---|---|---|---|---|
| No. | Ca | Mg | REM | Bi | Zr | Co | Zn | W | Sn | (° C.) | (° C.) | (° C.) | Note |
| A | 0.0018 | 0.0018 | | | | | | | | 720 | 552 | 473 | Invention Example |
| B | | | | | | | | | | 683 | 518 | 429 | Invention Example |
| C | | | 0.0012 | | | | | | | 658 | 511 | 404 | Invention Example |
| D | | | | 0.002 | | | | | | 653 | 501 | 442 | Invention Example |
| E | | | | | | | | | | 695 | 524 | 419 | Invention Example |
| F | | | | | | | | | | 759 | 617 | 462 | Invention Example |
| G | | | | | | | | | | 785 | 388 | 371 | Invention Example |
| H | | | | | | | | | | 958 | 403 | 383 | Invention Example |
| I | | | | | 0.06 | | | | | 729 | 564 | 466 | Invention Example |
| J | | | | | | | | | | 685 | 536 | 435 | Invention Example |
| K | | | | | | | | 0.03 | | 710 | 545 | 459 | Invention Example |
| L | | | | | | 0.05 | | | | 716 | 557 | 459 | Invention Example |
| M | | | | | | | | | | 667 | 500 | 419 | Invention Example |
| N | | | | | | | | | 0.025 | 716 | 540 | 459 | Invention Example |
| O | | | | | | | | | | 687 | 541 | 444 | Invention Example |
| P | | | | | | | 0.16 | | | 699 | 540 | 444 | Invention Example |
| Q | | | | | | | | | | 734 | 566 | 487 | Comparative Example |
| R | | | | | | | | | | 657 | 502 | 390 | Comparative Example |
| S | | | | | | | | | | 719 | 530 | 435 | Comparative Example |
| T | | | | | | | | | | 794 | 656 | 496 | Comparative Example |

TABLE 3

| | | Slab heating | | | Hot rolling | | | Cooling | |
|---|---|---|---|---|---|---|---|---|---|
| Manufacturing No. | Steel No. | Holding time Sec | Heating temperature ° C. | Retention time Sec | Sheet thickness reduction at 850° C. to 1100° C. % | T1 | Hot rolling completion temperature ° C. | Time until start of cooling Sec | Average cooling rate of accelerated cooling ° C./sec |
| 1 | A | 1187 | 1157 | 6615 | 93 | 720 | 885 | 1.2 | 89 |
| 2 | B | 1068 | 1298 | 8194 | 92 | 683 | 891 | 1.0 | 64 |
| 3 | B | 834 | 1199 | 7035 | 92 | 683 | 911 | 0.9 | 64 |
| 4 | B | 850 | 1238 | 6855 | 92 | 683 | 904 | 1.2 | 69 |
| 5 | B | 1135 | 1296 | 5320 | 92 | 683 | 896 | 0.9 | 57 |
| 6 | B | 995 | 1183 | 6730 | 87 | 683 | 908 | 1.1 | 69 |
| 7 | B | 1219 | 1281 | 7099 | 90 | 683 | 678 | 1.1 | 61 |
| 8 | B | 1131 | 1264 | 8137 | 91 | 683 | 907 | 1.7 | 60 |
| 9 | B | 1245 | 1285 | 7605 | 91 | 683 | 894 | 0.8 | 42 |
| 10 | B | 1166 | 1248 | 7300 | 93 | 683 | 885 | 0.9 | 55 |
| 11 | B | 1032 | 1250 | 7612 | 90 | 683 | 872 | 0.8 | 61 |
| 12 | B | 1136 | 1225 | 8028 | 93 | 683 | 881 | 1.1 | 59 |
| 13 | B | 1079 | 1281 | 6842 | 93 | 683 | 889 | 1.0 | 56 |
| 14 | B | 1157 | 1168 | 7674 | 93 | 683 | 887 | 1.3 | 65 |
| 15 | B | 1134 | 1251 | 7512 | 90 | 683 | 912 | 0.9 | 52 |
| 16 | B | 1246 | 1162 | 8073 | 92 | 683 | 902 | 0.8 | 62 |
| 17 | B | 997 | 1152 | 8342 | 92 | 683 | 905 | 0.9 | 60 |
| 18 | C | 956 | 1260 | 8492 | 92 | 658 | 911 | 1.0 | 97 |
| 19 | D | 1149 | 1241 | 7524 | 90 | 653 | 885 | 0.9 | 70 |
| 20 | E | 1106 | 1218 | 7543 | 91 | 695 | 898 | 0.9 | 103 |
| 21 | F | 1076 | 1298 | 8101 | 92 | 759 | 894 | 0.9 | 83 |
| 22 | G | 1017 | 1216 | 8079 | 91 | 785 | 890 | 1.2 | 92 |
| 23 | H | 1204 | 1220 | 7652 | 91 | 958 | 965 | 1.0 | 120 |
| 24 | I | 1109 | 1215 | 7909 | 91 | 729 | 915 | 0.9 | 105 |
| 25 | J | 1089 | 1265 | 9045 | 91 | 685 | 914 | 0.8 | 103 |
| 26 | K | 1004 | 1296 | 8592 | 92 | 710 | 908 | 1.0 | 71 |

TABLE 3-continued

| | | | | | | | | | |
|---|---|---|---|---|---|---|---|---|---|
| 27 | L | 966 | 1190 | 8052 | 91 | 716 | 895 | 1.3 | 88 |
| 28 | M | 1049 | 1243 | 7848 | 90 | 667 | 920 | 0.8 | 70 |
| 29 | N | 1007 | 1192 | 8679 | 91 | 716 | 898 | 1.1 | 66 |
| 30 | O | 953 | 1166 | 8763 | 93 | 687 | 901 | 1.2 | 93 |
| 31 | P | 1216 | 1221 | 7265 | 92 | 699 | 883 | 1.3 | 72 |
| 32 | Q | 1265 | 1275 | 8738 | 93 | 734 | 894 | 1.2 | 78 |
| 33 | R | 1048 | 1155 | 8847 | 91 | 657 | 889 | 0.9 | 87 |
| 34 | S | 1164 | 1278 | 8232 | 92 | 719 | 882 | 1.1 | 83 |
| 35 | T | 1051 | 1286 | 7633 | 93 | 794 | 908 | 1.3 | 74 |

| | Cooling | | | |
|---|---|---|---|---|
| Manufacturing No. | T2 | Cooling stop temperature of accelerated cooling ° C. | Average cooling rate from cooling stop temperature of accelerated cooling to coiling temperature ° C./sec | Note |
| 1 | 552 | 522 | 21 | Invention Example |
| 2 | 518 | 512 | 12 | Invention Example |
| 3 | 518 | 490 | 19 | Comparative Example |
| 4 | 518 | 506 | 17 | Comparative Example |
| 5 | 518 | 501 | 38 | Comparative Example |
| 6 | 518 | 508 | 21 | Comparative Example |
| 7 | 518 | 488 | 26 | Comparative Example |
| 8 | 518 | 499 | 18 | Comparative Example |
| 9 | 518 | 501 | 21 | Comparative Example |
| 10 | 518 | 565 | 40 | Comparative Example |
| 11 | 518 | 516 | 8 | Comparative Example |
| 12 | 518 | 499 | 25 | Comparative Example |
| 13 | 518 | 490 | 22 | Comparative Example |
| 14 | 518 | 505 | 25 | Comparative Example |
| 15 | 518 | 512 | 15 | Comparative Example |
| 16 | 518 | 491 | 35 | Invention Example |
| 17 | 518 | 499 | 29 | Invention Example |
| 18 | 511 | 487 | 25 | Invention Example |
| 19 | 501 | 471 | 13 | Invention Example |
| 20 | 524 | 512 | 26 | Invention Example |
| 21 | 617 | 605 | 34 | Invention Example |
| 22 | 388 | 382 | 11 | Invention Example |
| 23 | 403 | 399 | 13 | Invention Example |
| 24 | 564 | 552 | 21 | Invention Example |
| 25 | 536 | 525 | 39 | Invention Example |
| 26 | 545 | 523 | 18 | Invention Example |
| 27 | 557 | 534 | 24 | Invention Example |
| 28 | 500 | 479 | 20 | Invention Example |
| 29 | 540 | 512 | 19 | Invention Example |
| 30 | 541 | 512 | 27 | Invention Example |
| 31 | 540 | 525 | 23 | Invention Example |
| 32 | 566 | 539 | 21 | Comparative Example |
| 33 | 502 | 478 | 31 | Comparative Example |
| 34 | 530 | 501 | 44 | Comparative Example |
| 35 | 656 | 634 | 45 | Comparative Example |

Underlines indicate that the corresponding values do not follow preferable manufacturing conditions.

TABLE 4

| | | Coiling | | Cooling after coiling | | | | |
|---|---|---|---|---|---|---|---|---|
| Manufacturing No. | Steel No. | T3 | Coiling temperature ° C. | Holding time at 450° C. or higher Sec | Holding time at 400° C. or higher Sec | Holding time at 350° C. or higher Sec | Average cooling rate within temperature range of coiling temperature to coiling temperature - 10° C. ° C./sec | Note |
| 1 | A | 473 | 480 | 5400 | 15400 | 24500 | 0.006 | Invention Example |
| 2 | B | 429 | 500 | 8900 | 19200 | 31000 | 0.006 | Invention Example |
| 3 | B | 429 | 470 | 3600 | 14600 | 24000 | 0.006 | Comparative Example |
| 4 | B | 429 | 437 | 0 | 8400 | 17800 | 0.006 | Comparative Example |
| 5 | B | 429 | 430 | 0 | 9300 | 26500 | 0.006 | Comparative Example |
| 6 | B | 429 | 475 | 4500 | 14300 | 23800 | 0.006 | Comparative Example |
| 7 | B | 429 | 441 | 0 | 7400 | 16700 | 0.006 | Comparative Example |
| 8 | B | 429 | 430 | 0 | 5600 | 15000 | 0.006 | Comparative Example |
| 9 | B | 429 | 470 | 3600 | 6400 | 15500 | 0.006 | Comparative Example |
| 10 | B | 429 | 525 | 13600 | 22400 | 31500 | 0.007 | Comparative Example |

TABLE 4-continued

| Manufacturing No. | Steel No. | Coiling T3 | Coiling temperature ° C. | Cooling after coiling: Holding time at 450° C. or higher Sec | Holding time at 400° C. or higher Sec | Holding time at 350° C. or higher Sec | Average cooling rate within temperature range of coiling temperature to coiling temperature - 10° C. ° C./sec | Note |
|---|---|---|---|---|---|---|---|---|
| 11 | B | 429 | 472 | 3700 | 8400 | 21400 | 0.006 | Comparative Example |
| 12 | B | 429 | 410 | 0 | 8500 | 27000 | 0.001 | Comparative Example |
| 13 | B | 429 | 454 | 700 | 5400 | 14900 | 0.007 | Comparative Example |
| 14 | B | 429 | 435 | 0 | 5800 | 29200 | 0.006 | Comparative Example |
| 15 | B | 429 | 474 | 1900 | 3800 | 4200 | 0.013 | Comparative Example |
| 16 | B | 429 | 484 | 2500 | 16100 | 25400 | 0.015 | Invention Example |
| 17 | B | 429 | 430 | 0 | 8200 | 24800 | 0.013 | Invention Example |
| 18 | C | 404 | 425 | 0 | 8200 | 14100 | 0.006 | Invention Example |
| 19 | D | 442 | 458 | 1500 | 11300 | 20600 | 0.006 | Invention Example |
| 20 | E | 419 | 435 | 0 | 11300 | 28700 | 0.006 | Invention Example |
| 21 | F | 462 | 503 | 9600 | 19300 | 28800 | 0.006 | Invention Example |
| 22 | G | 371 | 375 | 0 | 0 | 30064 | 0.001 | Invention Example |
| 23 | H | 383 | 385 | 0 | 0 | 30015 | 0.001 | Invention Example |
| 24 | I | 466 | 524 | 14500 | 24100 | 33300 | 0.006 | Invention Example |
| 25 | J | 435 | 438 | 0 | 8500 | 19000 | 0.007 | Invention Example |
| 26 | K | 459 | 468 | 3200 | 11900 | 21000 | 0.006 | Invention Example |
| 27 | L | 459 | 479 | 5200 | 13900 | 23200 | 0.006 | Invention Example |
| 28 | M | 419 | 452 | 300 | 10100 | 19600 | 0.006 | Invention Example |
| 29 | N | 459 | 472 | 4000 | 13700 | 23000 | 0.006 | Invention Example |
| 30 | O | 444 | 458 | 1600 | 11300 | 20400 | 0.006 | Invention Example |
| 31 | P | 444 | 468 | 3200 | 13200 | 22300 | 0.006 | Invention Example |
| 32 | Q | 487 | 537 | 16200 | 28600 | 32800 | 0.006 | Comparative Example |
| 33 | R | 390 | 395 | 0 | 0 | 30600 | 0.001 | Comparative Example |
| 34 | S | 435 | 478 | 6700 | 18600 | 31200 | 0.006 | Comparative Example |
| 35 | T | 496 | 550 | 32500 | 42300 | 51500 | 0.006 | Comparative Example |

Underlines indicate that the corresponding values do not follow preferable manufacturing conditions.

TABLE 5

| Manufacturing No. | Sheet thickness mm | Ferrite Area % | Residual austenite Area % | $L_{52}/L_7$ — | Mn standard deviation Mass % | Standard deviation of Vickers hardness HV0.01 | Tensile strength TS MPa |
|---|---|---|---|---|---|---|---|
| 1 | 2.3 | 11.0 | 0.6 | 0.15 | 0.44 | 23 | 997 |
| 2 | 2.3 | 5.0 | 0.3 | 0.12 | 0.40 | 17 | 1105 |
| 3 | 2.3 | 2.0 | 1.7 | 0.11 | 0.71 | 19 | 1025 |
| 4 | 2.3 | 3.0 | 0.2 | 0.12 | 0.67 | 19 | 1045 |
| 5 | 2.3 | 4.0 | 0.1 | 0.18 | 0.74 | 18 | 1057 |
| 6 | 2.3 | 3.0 | 2.7 | 0.13 | 0.66 | 19 | 1062 |
| 7 | 2.3 | 17.0 | 1.1 | 0.11 | 0.42 | 23 | 916 |
| 8 | 2.3 | 16.0 | 2.2 | 0.11 | 0.40 | 25 | 950 |
| 9 | 2.3 | 23.0 | 0.3 | 0.12 | 0.41 | 27 | 942 |
| 10 | 2.3 | 16.0 | 1.0 | 0.11 | 0.40 | 22 | 960 |
| 11 | 2.3 | 9.0 | 0.5 | 0.16 | 0.42 | 28 | 965 |
| 12 | 2.3 | 7.0 | 0.8 | 0.23 | 0.43 | 19 | 1015 |
| 13 | 2.3 | 7.0 | 8.0 | 0.14 | 0.41 | 22 | 1134 |
| 14 | 2.3 | 5.0 | 7.0 | 0.11 | 0.41 | 22 | 1178 |
| 15 | 2.3 | 4.0 | 3.0 | 0.16 | 0.41 | 27 | 1145 |
| 16 | 2.3 | 2.0 | 1.4 | 0.15 | 0.41 | 26 | 1054 |
| 17 | 2.3 | 2.0 | 0.3 | 0.15 | 0.42 | 24 | 1124 |
| 18 | 2.3 | 0.0 | 2.8 | 0.11 | 0.45 | 17 | 1187 |
| 19 | 1.6 | 0.0 | 0.3 | 0.11 | 0.56 | 19 | 1067 |
| 20 | 2.3 | 2.0 | 2.2 | 0.16 | 0.45 | 19 | 1099 |
| 21 | 2.3 | 5.0 | 2.6 | 0.16 | 0.23 | 18 | 981 |
| 22 | 2.3 | 0.0 | 2.7 | 0.18 | 0.60 | 18 | 1189 |
| 23 | 2.3 | 13.0 | 2.8 | 0.17 | 0.46 | 19 | 982 |
| 24 | 6.0 | 4.0 | 2.7 | 0.11 | 0.40 | 19 | 1012 |
| 25 | 2.3 | 0.0 | 1.2 | 0.11 | 0.43 | 18 | 1056 |
| 26 | 2.6 | 2.0 | 1.7 | 0.16 | 0.44 | 17 | 1056 |
| 27 | 2.6 | 5.0 | 2.8 | 0.15 | 0.40 | 17 | 1026 |
| 28 | 2.6 | 1.0 | 1.6 | 0.11 | 0.45 | 17 | 1045 |

TABLE 5-continued

| | | | | | | | |
|---|---|---|---|---|---|---|---|
| 29 | 2.6 | 0.0 | 0.0 | 0.16 | 0.43 | 19 | 1087 |
| 30 | 2.6 | 0.0 | 2.8 | 0.11 | 0.39 | 19 | 1067 |
| 31 | 2.6 | 0.0 | 0.4 | 0.11 | 0.45 | 18 | 1027 |
| 32 | 2.6 | 16.0 | 0.8 | 0.16 | 0.40 | 27 | 869 |
| 33 | 2.6 | 0.0 | 0.2 | 0.18 | 0.44 | 19 | 1196 |
| 34 | 2.6 | 1.0 | 13.0 | 0.12 | 0.46 | 23 | 1018 |
| 35 | 2.6 | 16.0 | 2.8 | 0.16 | 0.18 | 24 | 847 |

| Manufacturing No. | Total elongation El % | TS × El MPa · % | Maximum value of height difference of end surface/ sheet thickness % | Difference between maximum value and minimum value of Vickers hardness HV0.1 | Note |
|---|---|---|---|---|---|
| 1 | 16.2 | 16151 | 14 | 87 | Invention Example |
| 2 | 14.4 | 15912 | 10 | 55 | Invention Example |
| 3 | 15.0 | 15375 | 22 | 66 | Comparative Example |
| 4 | 14.2 | 14839 | 20 | 59 | Comparative Example |
| 5 | 14.6 | 15432 | 19 | 61 | Comparative Example |
| 6 | 14.5 | 15399 | 19 | 81 | Comparative Example |
| 7 | 18.8 | 17221 | 14 | 98 | Comparative Example |
| 8 | 16.3 | 15485 | 15 | 114 | Comparative Example |
| 9 | 19.00 | 17898 | 15 | 125 | Comparative Example |
| 10 | 16.1 | 15456 | 15 | 103 | Comparative Example |
| 11 | 13.4 | 12931 | 14 | 106 | Comparative Example |
| 12 | 14.3 | 14944 | 25 | 73 | Comparative Example |
| 13 | 15.1 | 17123 | 20 | 107 | Comparative Example |
| 14 | 14.9 | 17552 | 21 | 97 | Comparative Example |
| 15 | 14.2 | 16259 | 19 | 124 | Comparative Example |
| 16 | 14.6 | 15388 | 13 | 112 | Invention Example |
| 17 | 12.8 | 14387 | 14 | 103 | Invention Example |
| 18 | 12.2 | 14481 | 9 | 54 | Invention Example |
| 19 | 13.2 | 14084 | 9 | 57 | Invention Example |
| 20 | 12.9 | 14177 | 9 | 75 | Invention Example |
| 21 | 15.2 | 14911 | 14 | 74 | Invention Example |
| 22 | 12.7 | 15100 | 16 | 62 | Invention Example |
| 23 | 20 | 19640 | 16 | 74 | Invention Example |
| 24 | 15.9 | 16091 | 15 | 73 | Invention Example |
| 25 | 14.8 | 15629 | 12 | 62 | Invention Example |
| 26 | 13.7 | 14467 | 11 | 60 | Invention Example |
| 27 | 15.4 | 15800 | 9 | 70 | Invention Example |
| 28 | 14.7 | 15362 | 12 | 60 | Invention Example |
| 29 | 14.4 | 15653 | 11 | 66 | Invention Example |
| 30 | 15.3 | 16325 | 13 | 66 | Invention Example |
| 31 | 14.9 | 15302 | 14 | 65 | Invention Example |
| 32 | 17.3 | 15034 | 11 | 104 | Comparative Example |
| 33 | 12.2 | 14591 | 19 | 54 | Comparative Example |
| 34 | 14.5 | 14761 | 28 | 134 | Comparative Example |
| 35 | 19.0 | 16093 | 15 | 112 | Comparative Example |

Underlines indicate that the corresponding values are outside the ranges of the present invention or unpreferable properties.

As can be seen from Table 5, in Manufacturing Nos. 1, 2, and 16 to 31, which were the invention examples, hot-rolled steel sheets having excellent strength, ductility and shearing workability were obtained. Furthermore, among the present invention examples, in Manufacturing Nos. 2 and 18 to 31 according to the preferable aspect, hot-rolled steel sheets having the above various properties and, furthermore, excellent workability of the end surface after shearing working were obtained.

On the other hand, in Manufacturing Nos. 3 to 15 and 32 to 35 in which the chemical composition and the microstructure were not within the ranges specified by the present invention, any one or more of the properties (tensile strength TS, ductility, and shearing workability) were poor. In addition, in Manufacturing No. 11, the formation of, in addition to ferrite, residual austenite, and a low-temperature structure, 6% of pearlite by area % was confirmed. Therefore, the tensile strength TS decreased.

INDUSTRIAL APPLICABILITY

According to the above aspect of the present invention, it is possible to provide a hot-rolled steel sheet having excellent strength, ductility, and shearing workability. In addition, according to the preferable aspect according to the present invention, it is possible to obtain a hot-rolled steel sheet having the above various properties and, furthermore, excellent workability of an end surface after shearing working.

The hot-rolled steel sheet according to the present invention is suitable as an industrial material used for vehicle members, mechanical structural members, and building members.

The invention claimed is:

1. A hot-rolled steel sheet comprising, as a chemical composition, by mass %:

C: 0.100% to 0.250%,
Si: 0.05% to 2.00%,
Mn: 1.00% to 4.00%,
sol. Al: 0.001% to 2.000%,
P: 0.100% or less,
S: 0.0300% or less,
N: 0.1000% or less,
O: 0.0100% or less,
Ti: 0% to 0.300%,
Nb: 0% to 0.100%, V: 0% to 0.500%,
Cu: 0% to 2.00%,
Cr: 0% to 2.00%,
Mo: 0% to 1.00%,
Ni: 0% to 2.00%,
B: 0% to 0.0100%,
Ca: 0% to 0.0200%,
Mg: 0% to 0.0200%,
REM: 0% to 0.1000%,
Bi: 0% to 0.020%,
one or more of Zr, Co, Zn, and W: 0% to 1.00% in total,
Sn: 0% to 0.050%, and
a remainder comprising Fe and impurities,
wherein, in a microstructure,
by area %, ferrite is less than 15.0%, residual austenite is less than 3.0%,
$L_{52}/L_7$, which is a ratio of a length $L_{52}$ of a grain boundary having a crystal orientation difference of 52° to a length $L_7$ of a grain boundary having a crystal orientation difference of 7° about a <110> direction, is 0.10 to 0.18,
a standard deviation of a Mn concentration is 0.60 mass % or less,
a tensile strength is 980 MPa or more, and
a standard deviation of Vickers hardness is 20 HV0.01 or less.

2. The hot-rolled steel sheet according to claim 1, wherein, in the microstructure,
by the area %, the ferrite is 10.0% or less.

3. The hot-rolled steel sheet according to claim 1, further comprising, as the chemical composition, by mass %, one or more selected from a group of:
Ti: 0.005% to 0.300%;
Nb: 0.005% to 0.100%;
V: 0.005% to 0.500%;
Cu: 0.01% to 2.00%;
Cr: 0.01% to 2.00%;
Mo: 0.01% to 1.00%;
Ni: 0.02% to 2.00%;
B: 0.0001% to 0.0100%;
Ca: 0.0005% to 0.0200%;
Mg: 0.0005% to 0.0200%;
REM: 0.0005% to 0.1000%; and
Bi: 0.0005% to 0.020%.

4. The hot-rolled steel sheet according to claim 2, further comprising, as the chemical composition, by mass %, one or more selected from a group of:
Ti: 0.005% to 0.300%;
Nb: 0.005% to 0.100%;
V: 0.005% to 0.500%;
Cu: 0.01% to 2.00%;
Cr: 0.01% to 2.00%;
Mo: 0.01% to 1.00%;
Ni: 0.02% to 2.00%;
B: 0.0001% to 0.0100%;
Ca: 0.0005% to 0.0200%;
Mg: 0.0005% to 0.0200%;
REM: 0.0005% to 0.1000%; and
Bi: 0.0005% to 0.020%.

* * * * *